US006959833B1

(12) United States Patent
Paul

(10) Patent No.: US 6,959,833 B1
(45) Date of Patent: Nov. 1, 2005

(54) TRASH BIN SYSTEM

(75) Inventor: Samuel Louis Paul, Reno, NV (US)

(73) Assignee: Nextep, Reno, NV (US)

( * ) Notice: Subject to any disclaimer, the term of this patent is extended or adjusted under 35 U.S.C. 154(b) by 152 days.

(21) Appl. No.: 10/448,052

(22) Filed: May 27, 2003

(51) Int. Cl.[7] ..... B65D 25/10; B65D 53/00; B65D 81/24

(52) U.S. Cl. ..... 220/752; 220/756; 220/495.06; 220/908.1

(58) Field of Search ..... 220/1.6, 495.01, 220/495.06, 495.11, 752, 755, 756, 757, 769, 220/908, 908.1; 16/425, 902

(56) References Cited

U.S. PATENT DOCUMENTS 4,027,774 A * 6/1977 Cote ..... 220/495.11
4,867,339 A * 9/1989 Hahn ..... 220/495.1
4,923,087 A * 5/1990 Burrows ..... 220/495.1
4,938,380 A * 7/1990 Donahoe ..... 220/495.1
5,184,836 A * 2/1993 Andrews et al. ..... 280/79.5
5,881,901 A * 3/1999 Hampton ..... 220/495.08
6,123,215 A * 9/2000 Windle ..... 220/495.07

* cited by examiner

*Primary Examiner*—Nathan J. Newhouse
*Assistant Examiner*—Harry Grosso
(74) *Attorney, Agent, or Firm*—John D. Long

(57) ABSTRACT

A trash bin comprises a body forming a base coupled to a first side wall and a second side wall. A front wall and a rear wall are coupled to the first side wall and the second side wall defining an interior and an exterior of the body. A rim is formed in the first side wall, the second side wall, the front wall and the rear wall integrally opposite the base of the body. A first handle is formed integrally in the rim proximate the first side wall. A second handle is formed integrally in the rim proximate the second side wall. A first handle insert is coupled to the first handle. A second handle insert is coupled to the second handle. An opposing set of mounts are formed in the first and the second handle. The handle inserts and mounts act to fix a plastic trash liner in place.

6 Claims, 6 Drawing Sheets

TRASH BIN SYSTEM

BACKGROUND

The present disclosure relates to trash bin systems, specifically to a trash bin system with clamping handles for fixing plastic trash liners.

Trash cans, bins and baskets have been in use with plastic liner bags to store unwanted waste. A problem with the plastic liner bags is that the liner bags separate from the trash bin. The separation of the trash liner bag from the trash bin allows for waste material to fall between the trash liner and the trash can, thus contaminating the trash can with waste.

The trash bins in the prior art have attempted to solve the above problem by use of separate lids fitting over the top of the trash can and pressing the liner bag between the lid and top of the trash bin. Other prior art relies on a drawstring contiguous with the opening of the liner bag. The drawstring is cinched around the top of the trash bin to hold the liner bag in place.

The prior art solutions fail to hold fast the liner bags due to the lids being loose and the drawstrings snapping.

What is needed in the art is a trash bin system that holds tightly to the trash bin top and prevents the liner bag from slipping allowing waste material to contaminate the inside of the trash bin.

SUMMARY

The disclosed device is directed toward a trash bin system. The trash bin system comprises a body forming a base coupled to a first side wall and a second side wall opposite the first side wall. A front wall and a rear wall opposite the front wall are coupled to the first side wall and the second side wall defining an interior of the body and an exterior of the body. A rim is formed in the first side wall, the second side wall, the front wall and the rear wall integrally. The rim is opposite the base of the body. A first handle is formed integrally in the rim proximate the first side wall. A second handle is formed integrally in the rim proximate the second side wall and opposite the first side wall. A first handle insert is coupled to the first handle. A second handle insert is coupled to the second handle. An opposing set of mounts are formed in the first handle and are formed in the second handle distal from the first handle insert and the second handle insert respectively.

A method of using a trash bin system is disclosed. The method comprises removing a lid from a top of a trash bin. The trash bin has a base and walls integral with the base extending substantially orthogonally from the base. The base and walls define an interior and an exterior. The top is opposite the base and is formed from the walls. The top defines an opposing set of handles integral with the top. Each of the handles include an insert mount formed integral with the handle. The insert mounts are configured to receive a set of handle inserts. The method includes disposing a trash bin liner into the interior. The trash bin liner has a closed bottom opposite an open top, wherein the closed bottom is disposed proximate the base in the interior of the trash bin. The method includes securing the trash bin liner open top to the top of the trash bin.

DETAILED DESCRIPTION

Persons of ordinary skill in the art will realize that the following description of the present disclosure is illustrative only and not in any way limiting. Other embodiments of the invention will readily suggest themselves to such skilled persons having the benefit of this disclosure.

The present disclosure describes a novel trash bin system that fixes a trash bin liner into place preventing the liner from collapsing into the trash bin. The trash bin system includes a pre-formed top having integral handles configured to receive a snap-fit handle insert. The handle insert reinforces the preformed handle and fixes a trash bin liner to the handle of the trash bin. The preformed handle also includes opposing and protruding mounts to facilitate securing the trash bin liner as well as for providing a hand-hold to the user for lifting the trash bin.

Figure 1:
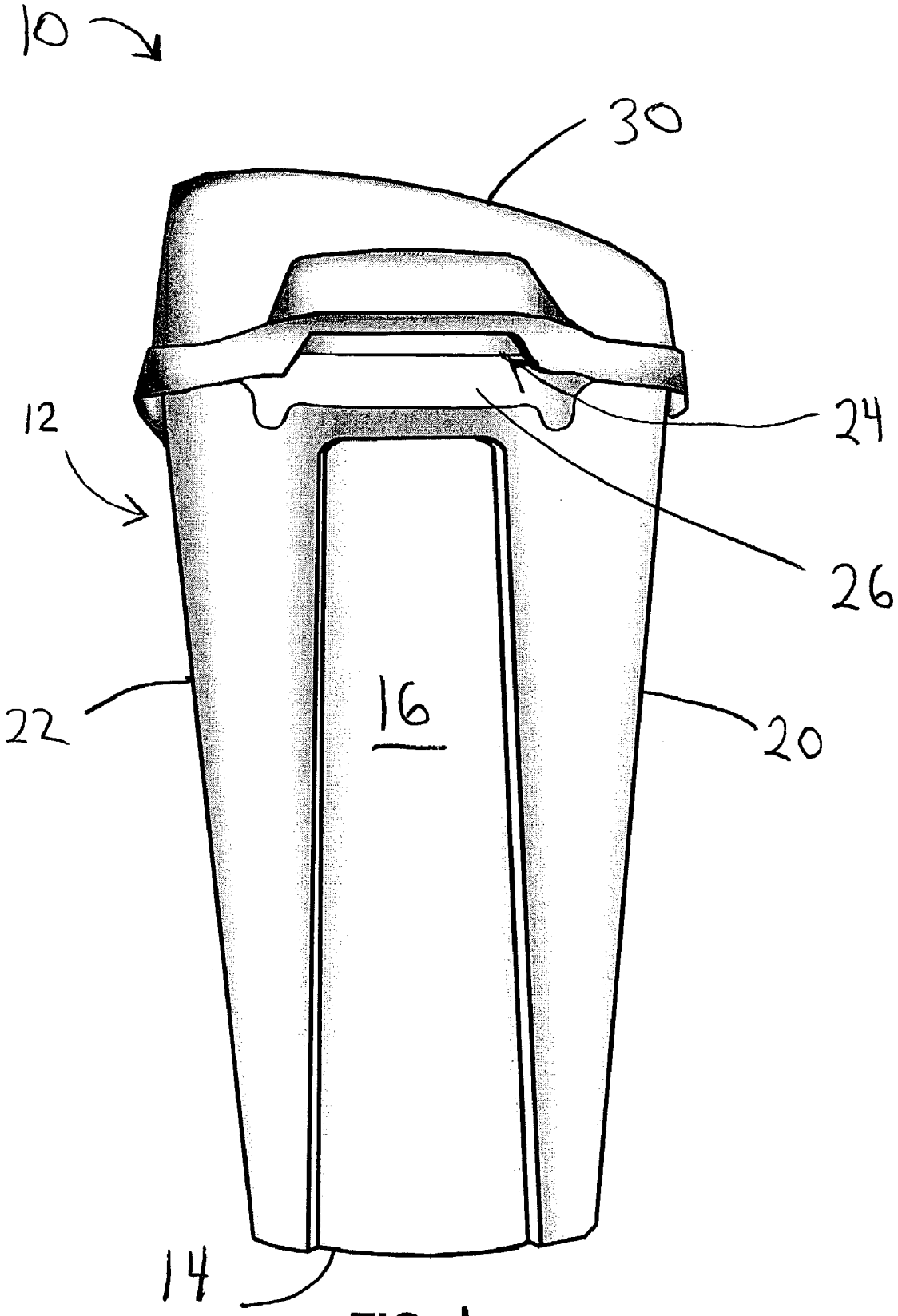
FIG. 1 is a side view of an exemplary trash bin with a lid.

Referring to FIG. 1 a side view of an exemplary trash bin system 10 is illustrated. The trash bin system 10 includes a body 12 forming a base 14 coupled to a first side wall 16 and a second side wall 18 opposite the first side wall 16. The body 12 includes a front wall 20 and a rear wall 22 opposite the front wall 20. The front wall 20 is coupled to the first side wall 16 and second side wall 18 (see FIG. 2). The rear wall 22 is coupled to the first side wall 16 and second side wall 18. The first and second side walls (16, 18) and the front and rear walls (20, 22) can all be formed integrally with the base 14. The walls (16, 18, 20, 22) extend and normally orient upward from the base 14. A perimeter or rim 24 is formed by all of the walls (16, 18, 20, 22) collectively. The rim 24 of the body 12 is opposite the base 14 of the body 12. A first handle 26 and a second handle 28 are formed in part from the rim 24. A lid 30 is mounted on top of the body 12 proximate the rim 24. The lid 30 is separable and couples to the rim 24 in a form fit manner. In a preferred embodiment, the body 12 is formed integral from a plastic material.

Figure 2:
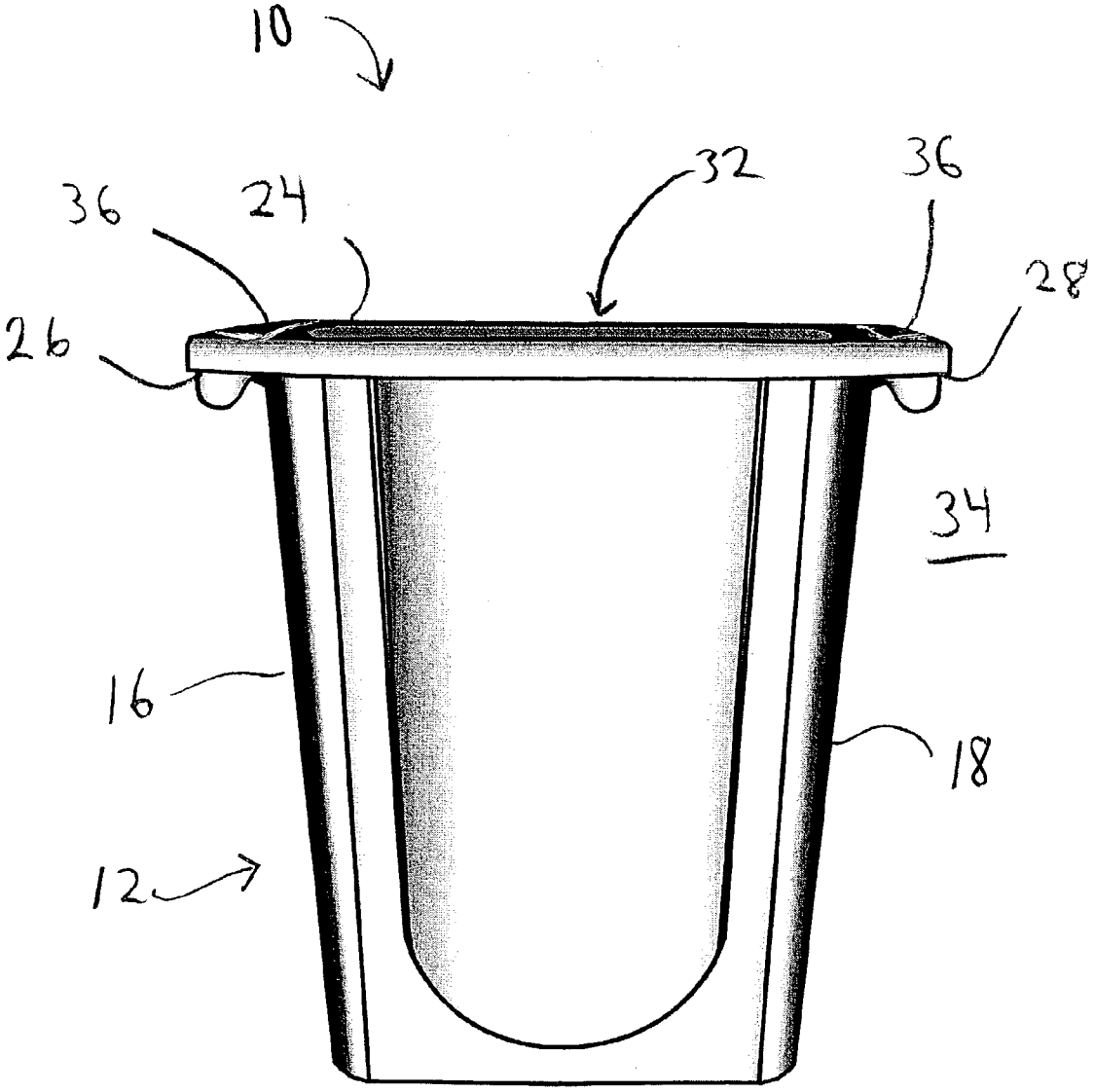
FIG. 2 is a front view of an exemplary trash bin with handle inserts installed.
Figure 3:
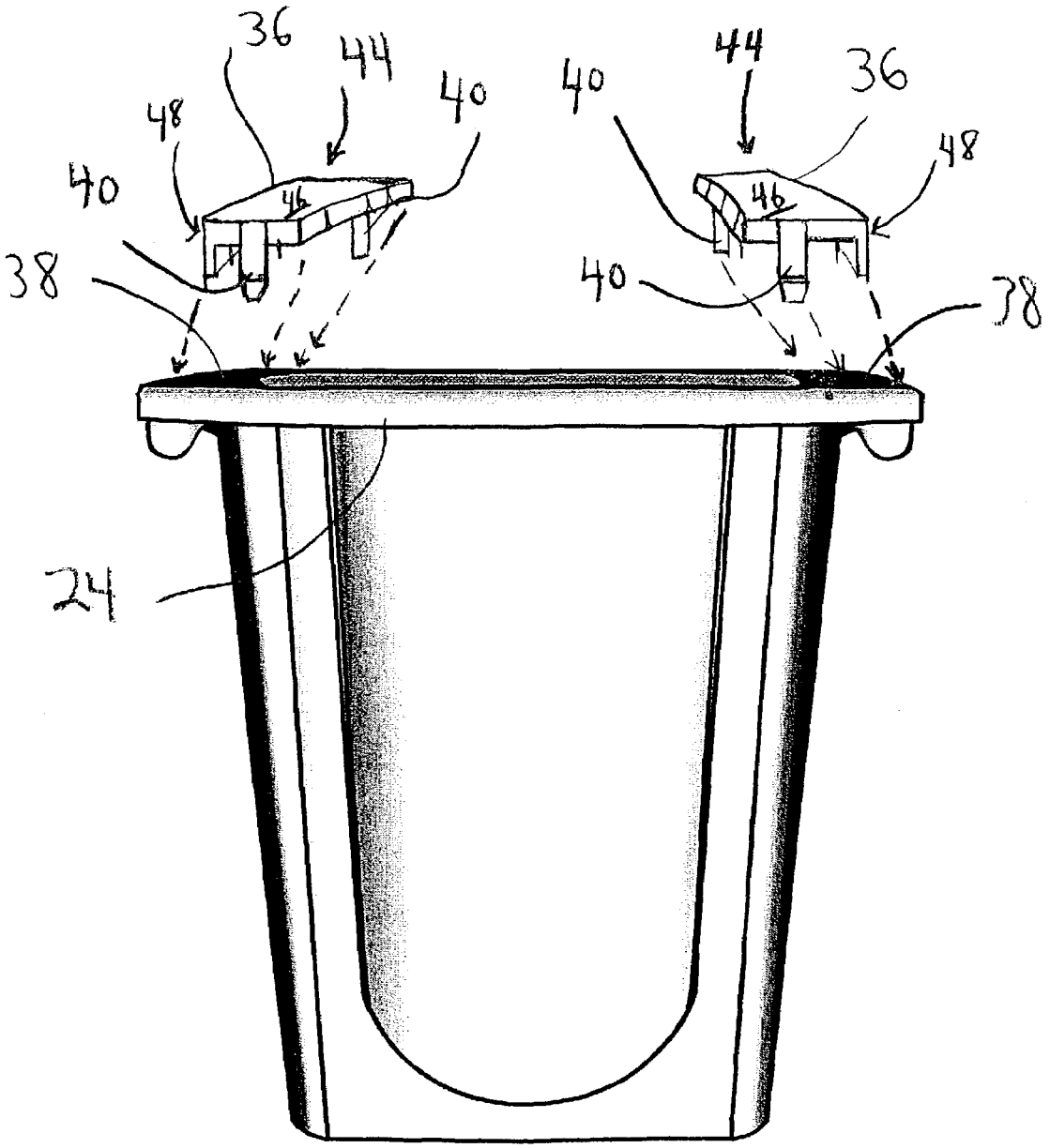
FIG. 3 is a front view of an exemplary trash bin with handle inserts removed.

Referring to FIGS. 2 and 3, a front view of an exemplary trash bin system is illustrated without the lid. The body 12 forming the rim 24 is shaped in a flared or bell shaped curve. The rim 24 formed from the body 12 provides a more rigid structure for supporting trash bin liners as well as maintaining the integrity of the trash bin system 10. The base 14 and walls (16, 18, 20, 22) collectively define an interior 32 and an exterior 34 of the trash bin body 12. The first handle 26 and second handle 28 are in part, formed by the rim 24. The second handle 28 is located opposite the first handle 26. A handle insert 36 or simply insert 36 forms the other part of the handles (26, 28). The handle insert 36 is demountably insertable into an insert mount 38 formed in each of the handles (26, 28). A tab 40 is formed in the handle insert 36 to be snap fit into a receiver 42 formed in the insert mount 38 of the handles (26, 28). Each handle insert 36 includes two opposing tabs 40.

Figure 4:
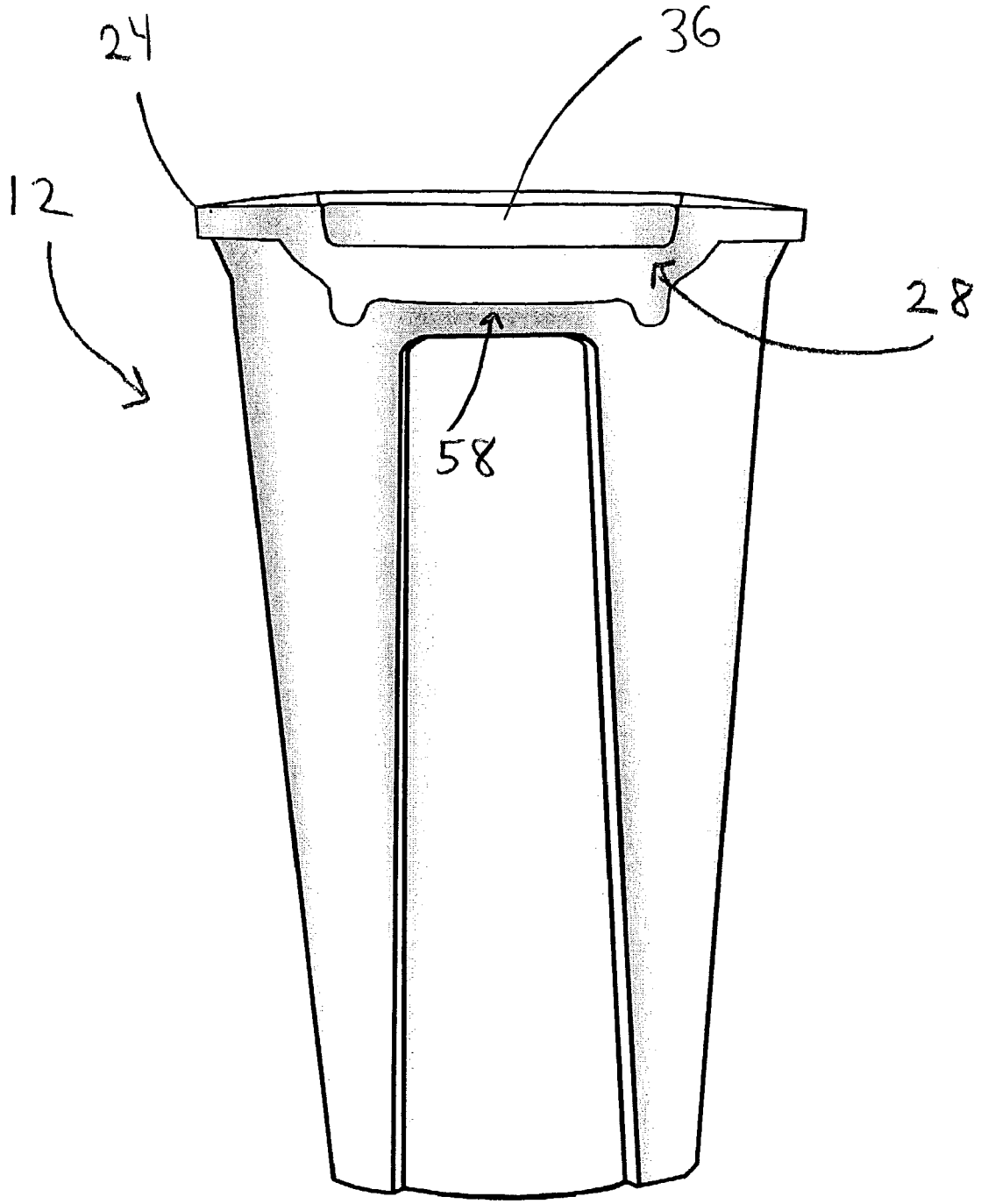
FIG. 4 is a side view of an exemplary trash bin with handle inserts installed.
Figure 5:
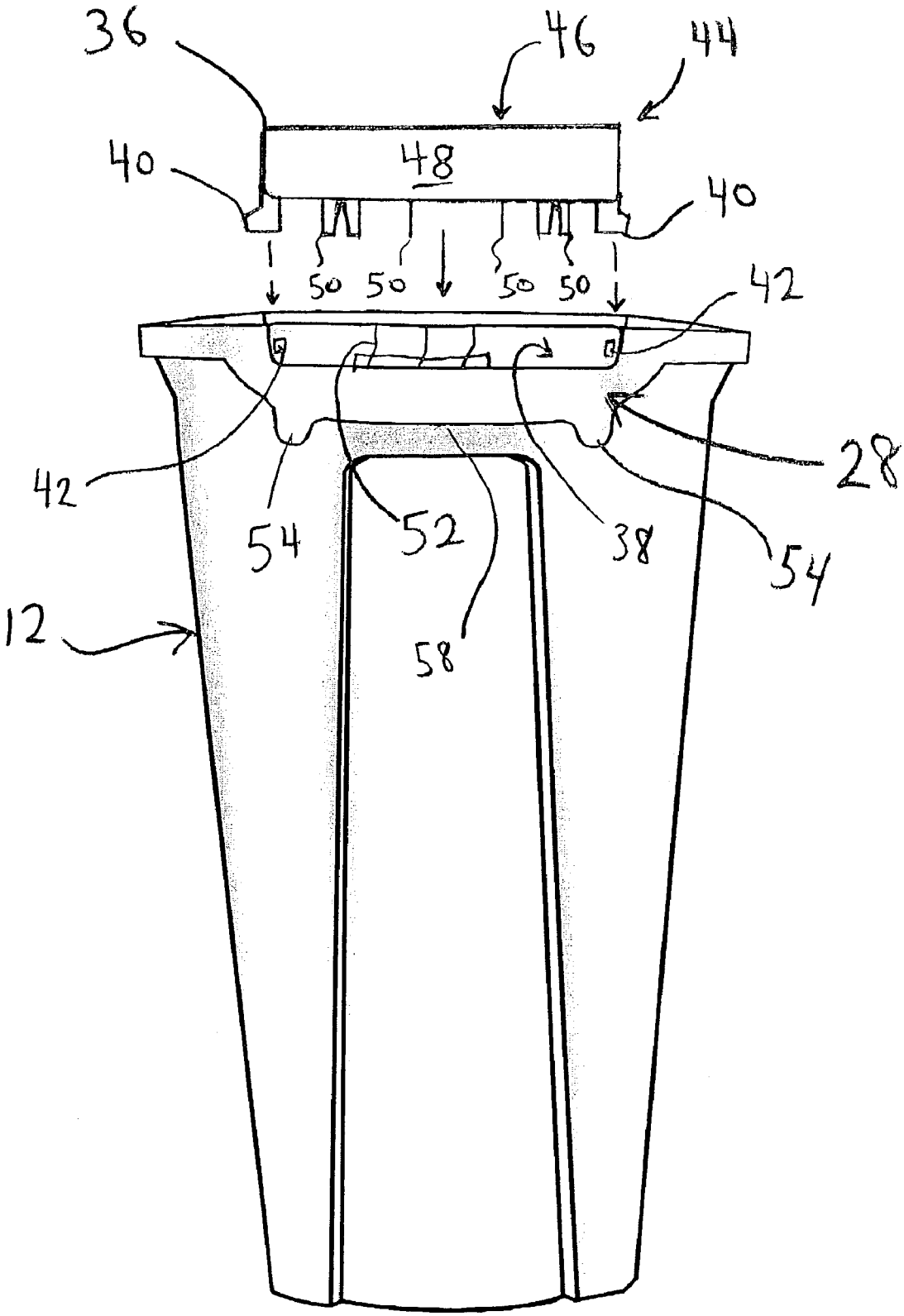
FIG. 5 is a side view of an exemplary trash bin with handle inserts removed.

Referring also to FIGS. 4 and 5, a side view of the exemplary trash bin system is illustrated without the lid. At FIG. 4 the handle insert 36 is shown inserted. At FIG. 5 the handle insert is shown removed. The handle insert 36 includes an insert body 44 having a top face 46 and a side face 48 adjacent to the top face 46 and reinforcement elements 50 protruding out from the body 44 opposite the top face 46. The reinforcement elements 50 interact or interlace with ribs 52 formed in the handles (26, 28) at the insert mount 38. The ribs 52 and reinforcement elements 50 mesh to stiffen the handles (26, 28) as well as act to trap and bind a trash liner (not shown) captured beneath the handle insert 36.

A set of opposing protruding mounts or simply mounts 54 are formed integral with the handle 28 at a surface distal from the top and facing the base 14. The mounts 54 provide a barrier to prevent the unwanted slippage of the trash bin liner (not shown) off of the handles (26, 28). The mounts 54 also provide a lateral hand-hold allowing for superior grip of the handle 28. The mounts 54 are formed integral with the handle 28 in a preferred embodiment but can also be coupled to the handle 28. The mounts 54 can be rectilinear nubs extending out from the handle 28. The mounts 54 can be ridges set apart along the handle to form opposing structures with a curvelinear surface between acting as a or gripping surface 58. The mounts 54 on the handle 28 bound the gripping surface 58 forming the handhold. The mounts 54 have sufficient length and thickness to act as a no-slip barrier as well as to aesthetically conform to the size and shape of the handle 28.

Figure 6:
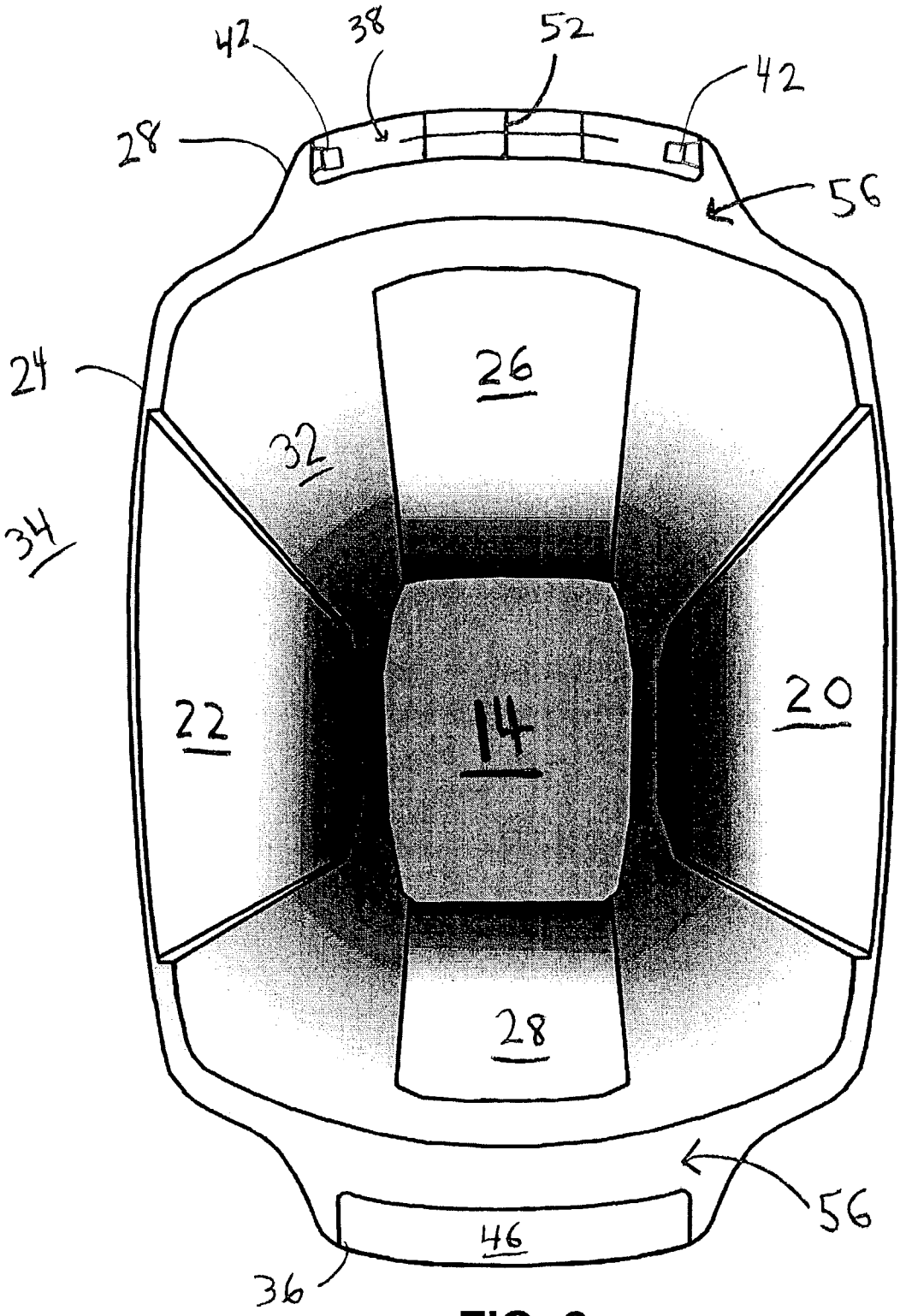
FIG. 6 is top view of an exemplary trash bin with one handle insert installed and no lid.

FIG. 6 illustrates a top view of the exemplary trash bin system with the lid removed and with one handle insert removed and one handle insert installed. The top view displays the insert mount 38 and the ribs 52 and the receivers 42 at opposite ends of the insert mount 38. The handle insert 36 also provides a stiffener feature to the handle 28 formed in the rim 24. FIG. 6 also illustrates that the rim 24 forming the handles (26, 28) has an extended surface 56 that acts to support the lid 30 as well as provide sufficient space for an individual's hands (not shown) to grasp the handles (26, 28).

In use, the exemplary embodiment of the trash bin system 10 is used to contain waste. In order to prepare the trash bin system 10 for receiving waste a liner is inserted into the interior 32 of the body 12. The trash bin liner having a closed end and an open end is inserted closed end first. The closed end is urged proximate the base 14 at the interior 32. The open end having a perimeter is positioned about the rim 24 and over the handles (26, 28). If the trash bin liner has preformed handle openings, then the handle openings formed at the perimeter of the open end are individually urged over the handle and past the mounts 54. The unique structure of the handles (26, 28) hold the liner open end fixed to the rim 24. For the trash bin liners lacking handle openings, the handle inserts 36 are removed. The open end of the trash liner is stretched over the extended surface 56 and over the insert mounts 38. The handle insert 36 is reinserted and latched into the receivers 42. The snap fit of the handle inserts 36 binds the trash bin liner into place and fixes the liner preventing any slippage or collapsing of the liner into the interior 32 of the trash bin.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A trash bin system comprising:

a body forming a base coupled to a first side wall and a second side wall opposite said first side wall, said body having a front wall and a rear wall opposite said front wall are coupled to said first side wall and said second side wall defining an interior and an exterior of said body;

a rim formed in said first side wall, in said second side wall, in said front wall and in said rear wall integrally, said rim opposite said base of said body;

a first handle formed integrally in said rim proximate said first side wall;

a second handle formed integrally in said rim proximate said second side wall and opposite said first side wall;

an opposing set of mounts formed in said first handle and formed in said second handle;

a first handle insert coupled to said first handle; and a second handle insert coupled to said second handle, wherein said first handle insert and said second handle insert include a body having a top face and a side face orthogonal to said top face, and an opposing set of tabs formed from said top face extending parallel to said side face distally from said top face.

2. The trash bin system of claim 1 wherein said opposing set of tabs are insertable in a corresponding opposing set of receivers formed in an insert mount formed in each of said first and second handles, wherein said receivers are configured to receive said tabs.

3. The trash bin system of claim 1 wherein said mounts are configured to retain a trash bin liner disposed over said first and second handles.

4. The trash bin system of claim 1 wherein said first and second handle inserts include at least one reinforcement element formed distally from said top surface parallel with said tabs.

5. The trash bin system of claim 4 wherein said reinforcing elements are insertable in a corresponding rib formed in an insert mount formed in each of said first and second handles, wherein said ribs are configured to receive said reinforcing elements.

6. The trash bin system of claim 1 wherein said first and second handle inserts are configured to retain a trash bin liner disposed over said first and second handles.

* * * * *